US009439524B2

(12) United States Patent
Liang

(10) Patent No.: US 9,439,524 B2
(45) Date of Patent: Sep. 13, 2016

(54) ANTI-SPRAY DRINKING BOTTLE

(71) Applicant: Hsiao-Chen Liang, Chang Hua Hsien (TW)

(72) Inventor: Hsiao-Chen Liang, Chang Hua Hsien (TW)

( * ) Notice: Subject to any disclaimer, the term of this patent is extended or adjusted under 35 U.S.C. 154(b) by 0 days.

(21) Appl. No.: 14/531,849

(22) Filed: Nov. 3, 2014

(65) Prior Publication Data

US 2016/0120343 A1 May 5, 2016

(51) Int. Cl.

| | |
|---|---|
| ***A47G 19/22*** | (2006.01) |
| ***B65D 41/04*** | (2006.01) |
| ***B65D 51/16*** | (2006.01) |
| ***B65D 51/18*** | (2006.01) |
| ***A47G 21/18*** | (2006.01) |

(52) U.S. Cl.

CPC ..... *A47G 19/2272* (2013.01); *A47G 19/2222* (2013.01); *A47G 21/18* (2013.01); *B65D 41/04* (2013.01); *B65D 51/1644* (2013.01); *B65D 51/18* (2013.01); *B65D 2251/0028* (2013.01); *B65D 2251/0078* (2013.01)

(58) Field of Classification Search

CPC ..... A47G 19/2272; A47G 19/2222; A47G 19/2205; B65D 41/04; B65D 51/1644; B65D 51/18

USPC ..... 215/229, 228, 311, 307; 220/203.19, 220/719, 212.5, 212, 707, 706, 705, 709, 220/203.02, 203.01, 254.3, 254.1, 367.1; 222/531, 568, 567, 566

See application file for complete search history.

(56) References Cited

U.S. PATENT DOCUMENTS

| | | | | |
|---|---|---|---|---|
| 4,448,316 | A * | 5/1984 | Hiroshige | B65D 77/283 215/229 |
| 5,234,117 | A * | 8/1993 | Garvin | A47G 21/18 215/11.1 |
| 5,337,918 | A * | 8/1994 | Wang | B65D 47/2012 215/229 |
| 5,520,304 | A * | 5/1996 | Lin | B65D 47/2043 215/229 |
| 7,044,316 | B1 * | 5/2006 | Hsu | A61J 9/006 215/11.1 |
| 2006/0226110 | A1 * | 10/2006 | Choi | B65D 47/065 215/228 |

* cited by examiner

*Primary Examiner* — Robert J Hicks
(74) *Attorney, Agent, or Firm* — Ming Chow; Sinorica, LLC

(57) ABSTRACT

An anti-spray drinking bottle has a body, a lid, at least one check valve, a dividing mount and a guiding element. The body has a storage recess and a screwing section. The lid is detachably connected to the body and has a threaded segment connected to the screwing section, a buffering segment connected to the threaded segment and a buffering space formed in the buffering segment. The at least one check valve is mounted on the lid. The dividing board is connected to the lid, is mounted in the body and has a dividing board, a sidewall, an outlet pipe and an abutting segment. The guiding element is connected to the dividing mount, is mounted in the body and has an elongate straw tube connected to the outlet pipe.

8 Claims, 7 Drawing Sheets

ANTI-SPRAY DRINKING BOTTLE

BACKGROUND OF THE INVENTION

1. Field of the Invention

The present invention relates to an anti-spray drinking bottle, and more particularly to an anti-spray drinking bottle that can prevent hot liquid or air directly flowing out of the anti-spray drinking bottle.

2. Description of Related Art

A conventional drinking bottle has a body, a lid and a straw. The body is hollow to store liquid. The lid is mounted on a top end of the body. The straw is mounted in the body and has an outer end extending out of the lid. Then, a user can drink the liquid in the body via the straw. However, the conventional drinking bottle does not have a relief structure and only can be used to store cold or slightly warm drinks or liquid. If the conventional drinking bottle is used to store hot drinks or hot liquid, the pressure inside the body is greater than the atmospheric pressure outside of the body and this will enable the hot drinks or hot air that formed by the hot drinks to directly flow out of the conventional drinking bottle via the straw. The flowing-out hot drinks or hot air may wet and dirty the user's clothing and even may burn the user. In particular, when the user is a child and the conventional drinking bottle is danger in use.

To overcome the shortcomings, the present invention provides an anti-spray drinking bottle for a baby bottle to mitigate or obviate the aforementioned problems.

SUMMARY OF THE INVENTION

The main objective of the present invention is to provide an anti-spray drinking bottle that can prevent hot liquid or air directly flowing out of the anti-spray drinking bottle.

The anti-spray drinking bottle in accordance with the present invention has a body, a lid, at least one check valve, a dividing mount and a guiding element. The body has a storage recess and a screwing section. The lid is detachably connected to the body and has a threaded segment connected to the screwing section, a buffering segment connected to the threaded segment and a buffering space formed in the buffering segment. The at least one check valve is mounted on the lid. The dividing board is connected to the lid, is mounted in the body and has a dividing board, a sidewall, an outlet pipe and an abutting segment. The guiding element is connected to the dividing mount, is mounted in the body and has an elongate straw tube connected to the outlet pipe.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
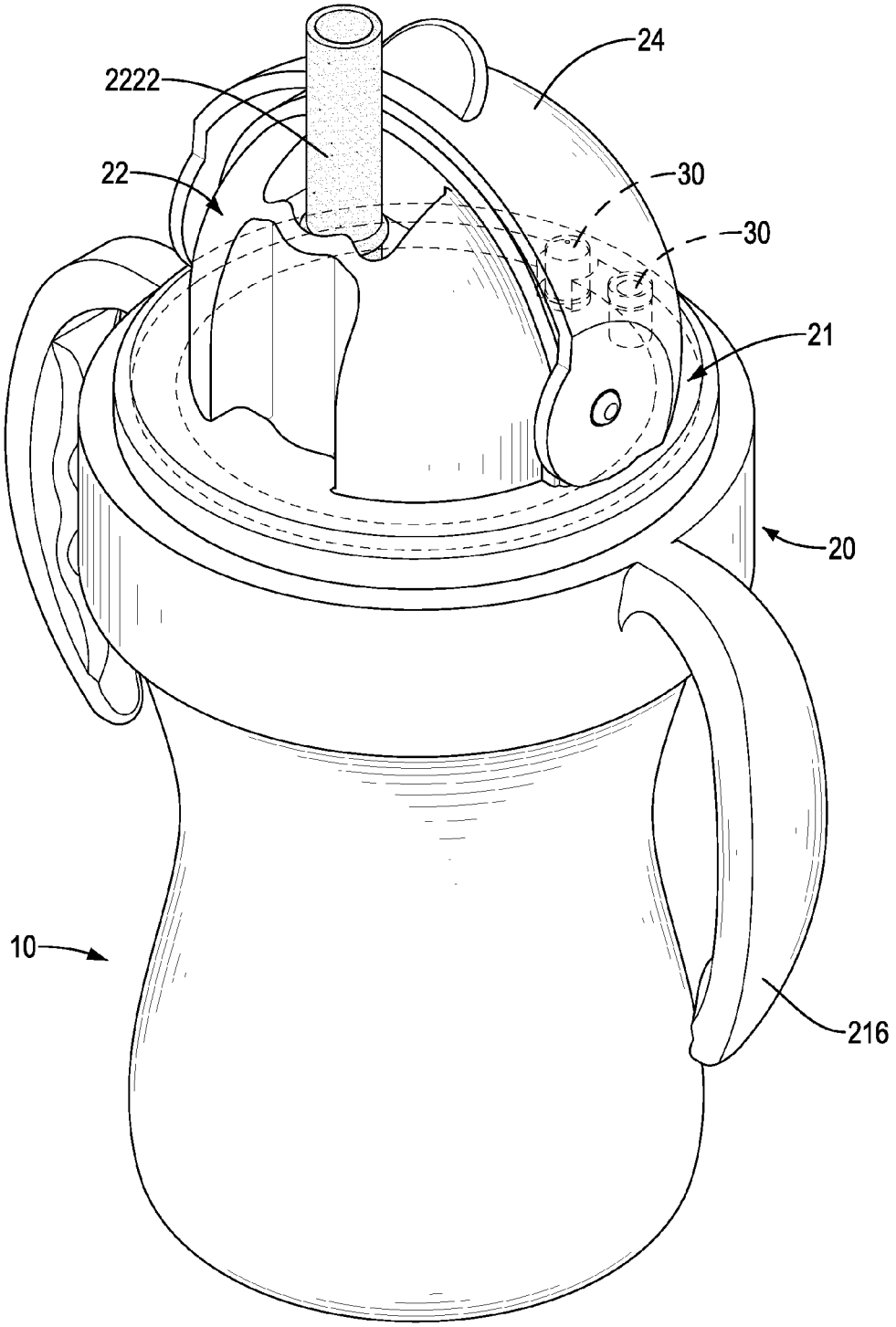
FIG. 1 is a perspective view of a first embodiment of an anti-spray drinking bottle in accordance with the present invention.
Figure 2:
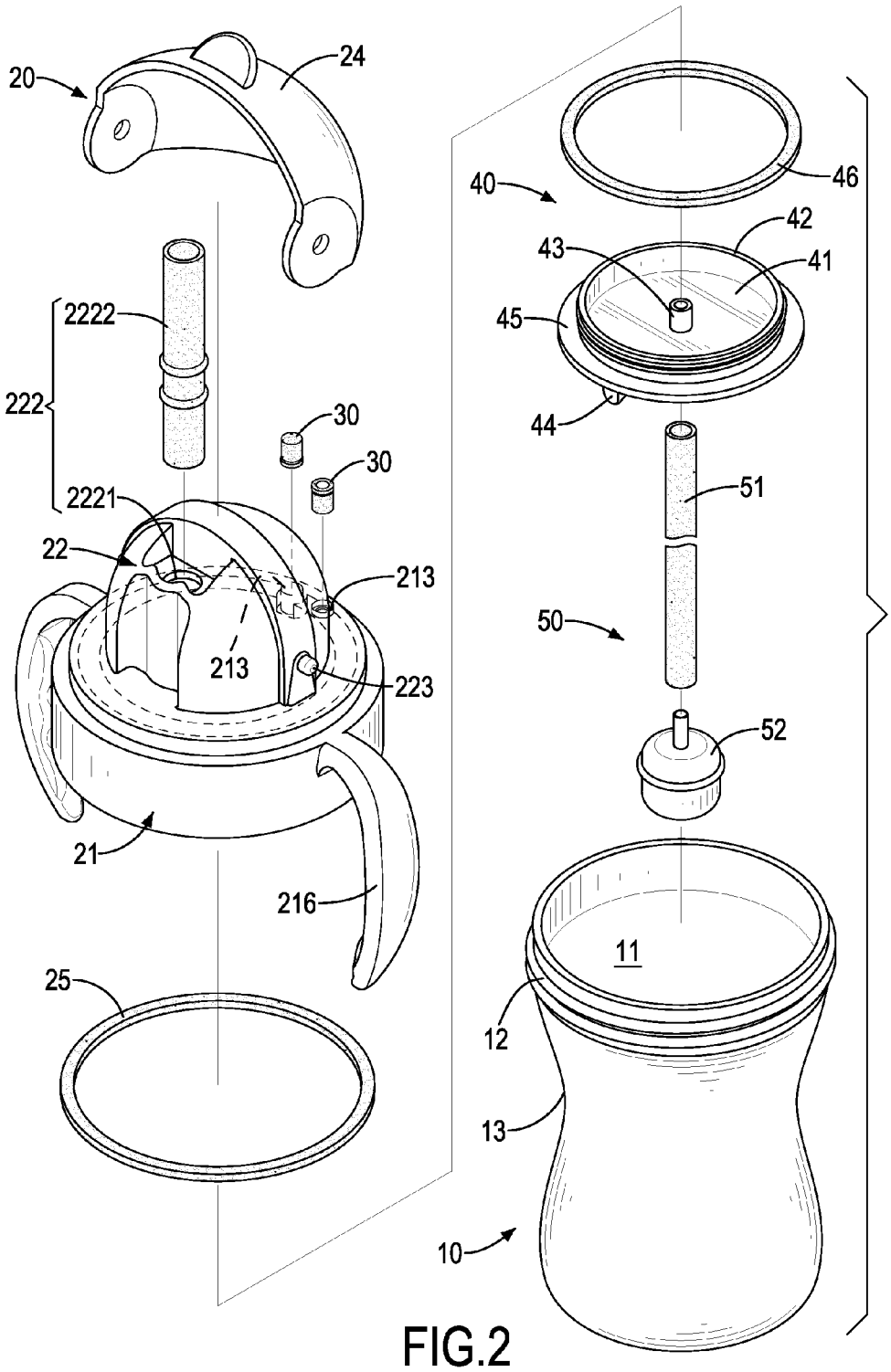
FIG. 2 is an exploded perspective view of the anti-spray drinking bottle in FIG. 1.

With reference to FIGS. 1 and 2, a first embodiment of an anti-spray drinking bottle in accordance with the present invention comprises a body 10, a lid 20, two check valves 30, a dividing mount 40 and a guiding element 50.

The body 10 has a closed bottom, an open top, an external surface, a middle, a storage recess 11, a screwing section 12 and a gripping section 13. The storage recess 11 is formed in the body 10 between the closed bottom and the open top of the body 10 and communicates with the open top of the body 10. The screwing section 12 is formed on the external surface of the body 10 around the open top of the body 10. The gripping section 13 is formed on the external surface of the body 10 at the middle of the body 10 to enable a user to securely hold the body 10.

Figure 3:
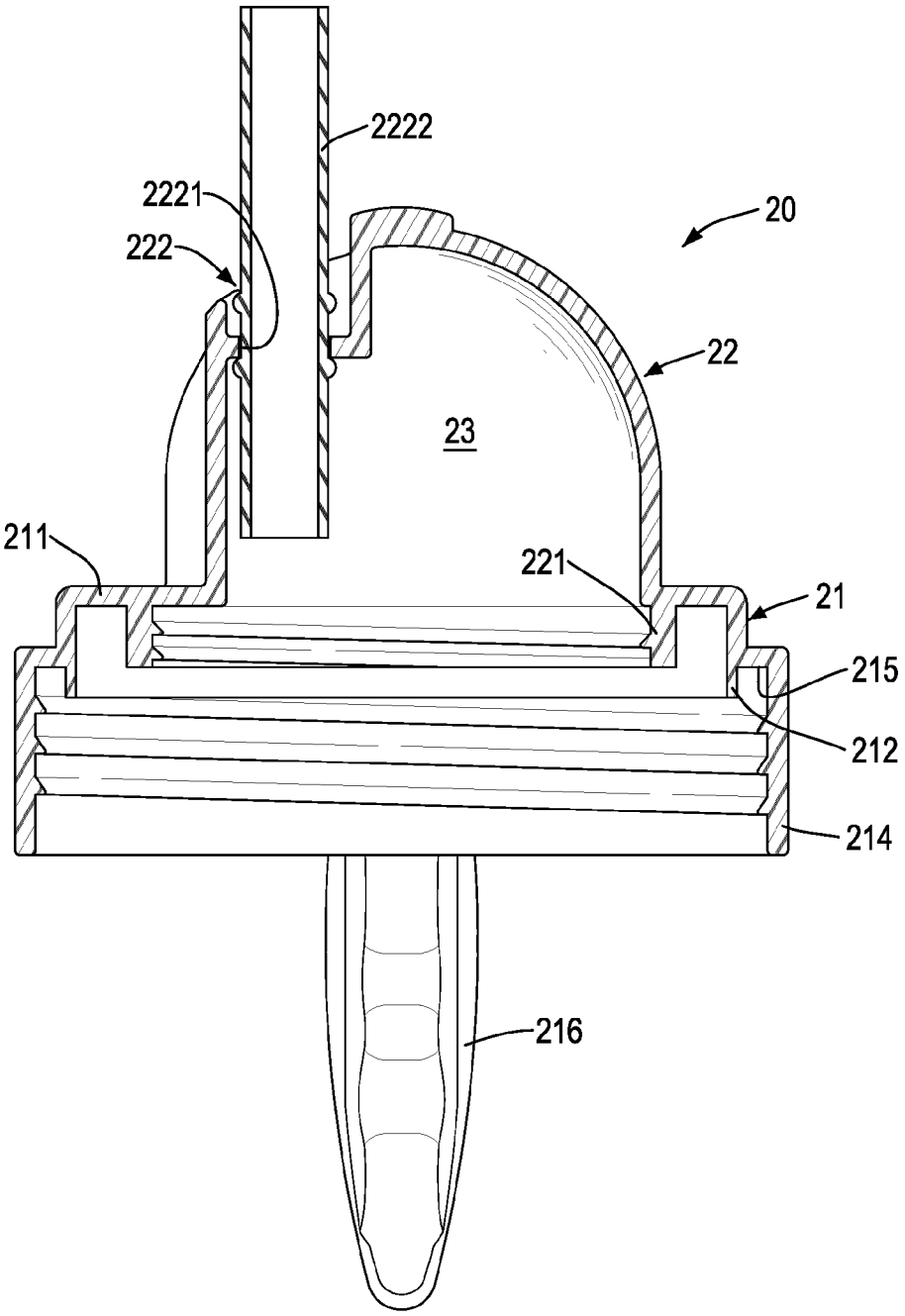
FIG. 3 is a cross sectional side view of a lid of the anti-spray drinking bottle in FIG. 1.

With reference to FIGS. 2 and 3, the lid 20 is detachably connected to the body 10 and has a bottom side, a top side, a threaded segment 21, a buffering segment 22, a buffering space 23, a cover 24 and a body sealing ring 25.

The threaded segment 21 is hollow, is formed on the bottom side of the lid 20 and is connected to the screwing section 12 of the body 10. The threaded segment 21 has a bottom side, a top side, an external wall 214, an internal wall 212, an annular panel 211, two valve holes 213, a ring slot 215 and two handles 216. The external wall 214 is annular, is formed on the bottom side of the threaded segment 21 and is connected to the screwing section 12 of the body 10. The internal wall 212 is annular, is formed on the top side of the threaded segment 21 and is formed with the external wall 214 of the threaded segment 21. In addition, the internal wall 212 of the threaded segment 21 has a diameter smaller than a diameter of the external wall 214 of the threaded segment 21 to form a step structure between the walls 212, 214 of the threaded segment 21.

The annular panel 211 is hollow, is formed on a top edge of the internal wall 212 of the threaded segment opposite to the external wall 214 of the threaded segment 21 and has an inner periphery. The valve holes 213 may be circular and are formed through the annular panel 211. The ring slot 215 is formed in the threaded segment 21 between the internal wall 212 and the external wall 214 of the threaded segment 21. The handles 216 are formed on and protrude from the external wall 214 of the threaded segment 21 to provide a holding effect to the user.

The buffering segment 22 may be hemispherical, is connected to the threaded segment 21 and has a diameter, a bottom side, a top side, an external surface, a screw tube 221, a drawing element 222 and two pivot rods 223. The diameter of the buffering segment 22 is smaller than a diameter of the annular panel 211 of the threaded segment 21. The bottom side of the buffering segment 22 is formed with the inner periphery of the annular panel 211. The screw tube 221 is formed on and protrudes downwardly from the bottom side of the buffering segment 22 and extends into the internal wall 212 of the threaded segment 21.

The drawing element 222 is connected to the buffering segment 22 and has a straw hole 2221 and a straw 2222. The straw hole 2221 may be circular and is formed through the external surface of the buffering segment 22 near the top side of the buffering segment 22. The straw 2222 may be a soft tube, is connected to the straw hole 2221 and has an external surface, an inner end, an outer end and two holding rings. The inner end of the straw 2222 extends in the screw tube 221 via the straw hole 2221. The outer end of the straw 2222 extends out of the external surface of the buffering segment 22 via the straw hole 2221. The holding rings are formed around the external surface of the straw 2222 at interval to enable the straw 2222 to hold with the straw hole 2221 of the drawing element 222. In addition, the drawing element 222 may be formed with the buffering segment 22 as a single piece. The pivot rods 223 are formed on and protrude from the external surface of the buffering segment 22 near the threaded segment 21 beside the drawing element 22 and align with the handles 216.

The buffering space 23 is formed in the buffering segment 22 between the top side and the bottom side of the buffering segment 22 and communicates with the inner end of the straw 2222. The cover 24 may be a quarter spherical cap and is pivotally connected to the pivot rods 223 to rotate relative to the buffering segment 22. When the cover 24 is rotated to cover the drawing element 22, the straw 2222 is bent by the cover 24 and this can prevent the liquid that is stored in the body 10 from flowing out of the lid 20 via the straw 2222. The body sealing ring 25 is an annular spacer and is mounted in the ring slot 215 of the threaded segment 21.

The check valves 30 are respectively connected to the valve holes 213 of the lid 20, and the air flowing directions of the check valves 30 are different. The air flowing direction of one of the check valves 30 is flowed in the body 10 via the corresponding check valve 30, and the air flowing direction of the other check valve 30 is flowed out of the body 10 via the corresponding check valve 30. Then, the check valves 30 can respectively provide discouraging and intake effects to the body 10 when the lid 20 is connected to the body 10.

Figure 4:
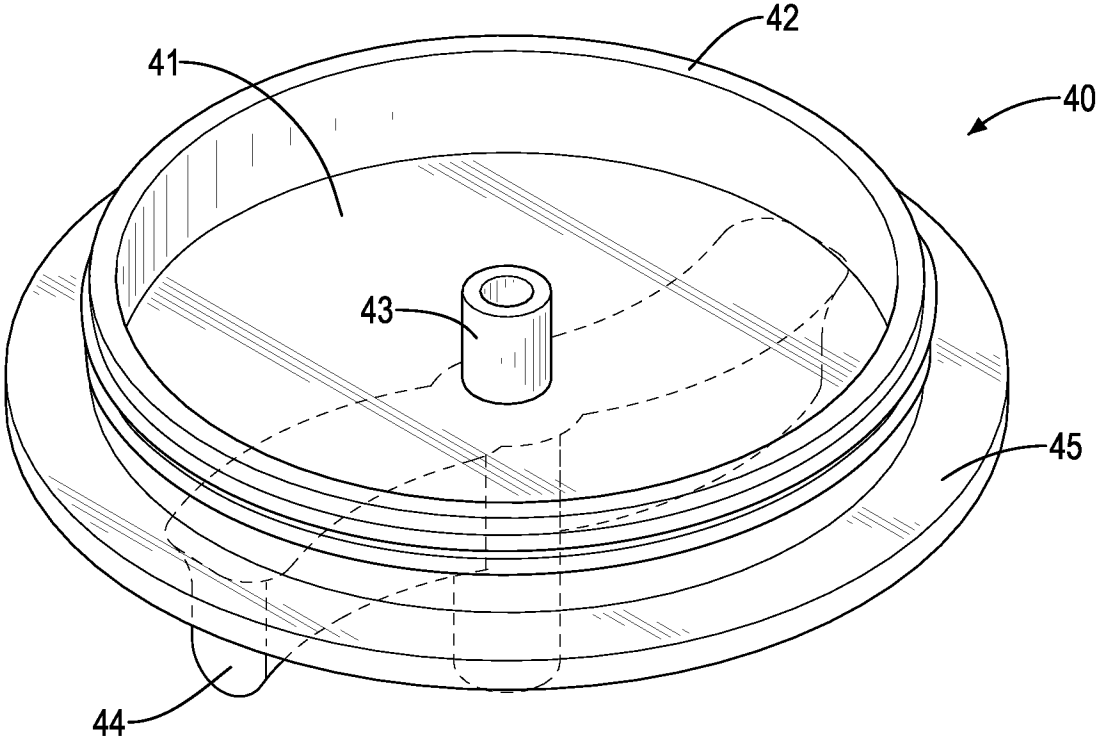
FIG. 4 is an enlarged perspective view of a dividing mount of the anti-spray drinking bottle in FIG. 1.
Figure 5:
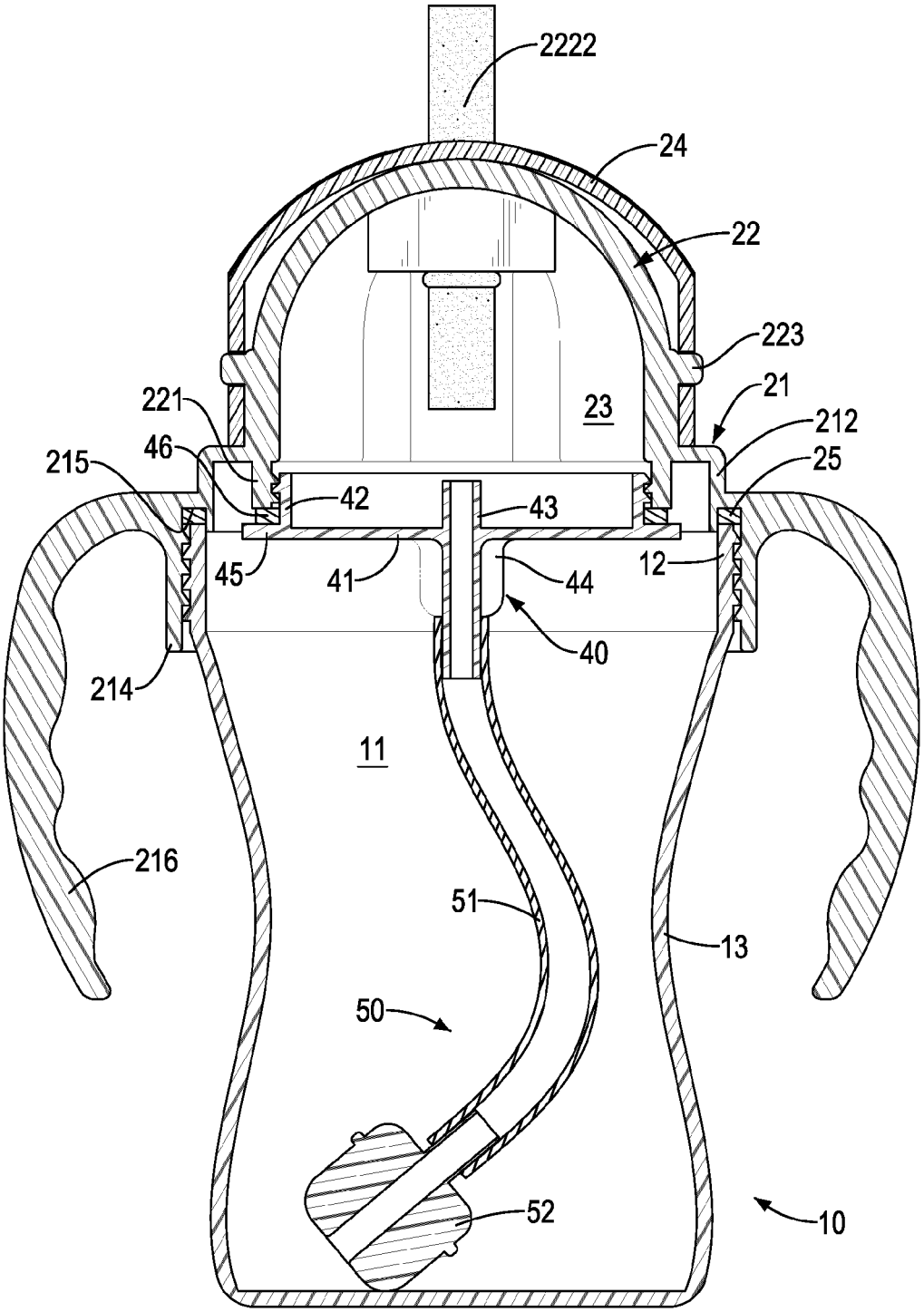
FIG. 5 is cross sectional side view of the anti-spray drinking bottle in FIG. 1.

With reference to FIGS. 2, 4 and 5, the dividing mount 40 is connected to the lid 20, is mounted in the body 10 and has a dividing board 41, a sidewall 42, an outlet pipe 43, a turning arm 44, an abutting segment 45 and a mount sealing ring 46. The dividing board 41 is mounted between the body 10 and the screw tube 221 of the lid 20 when the lid 20 is connected to the body 10 and has a top side, a bottom side and an outer periphery. The sidewall 42 is formed on and protrudes upwardly from the top side of the dividing board 41 around the outer periphery of the dividing board 41 and is securely connected to the screw tube 221 of the lid 20. Then, the dividing mount 40 can be connected to the lid 20 by the sidewall 42 of the dividing mount 40 and the screw tube 221.

The outlet pipe 43 is connected to the dividing board 41 and has an upper end and a lower end. The upper end of the outlet pipe 43 extends out of the top side of the dividing board 41 and communicates with the buffering space 23 of the lid 20. In addition, a distance between the top side of the dividing board 41 and the upper end of the outlet pipe 43 is shorter than a height of the sidewall 42 of the dividing mount 40. The lower end of the outlet pipe 43 extends out of the bottom side of the dividing board 41 and extends into the storage recess 11 of the body 10.

The turning arm 44 is formed on and protrudes from the bottom side of the dividing board 41 to enable the user to turn the dividing mount 40 to securely connect with the screw tube 221 of the lid 20. The abutting segment 45 is annular, is formed around the outer periphery of the dividing board 41 and is formed with the sidewall 42 of the dividing mount 40. The mount sealing ring 46 is mounted around the sidewall 42 of the dividing mount 40 and securely abuts between the abutting segment 45 and the screw tube 221 when the dividing mount 40 is connected to the lid 20.

With reference to FIG. 2, the guiding element 50 is connected to the dividing mount 40, is mounted in the body 10 and has an elongate straw tube 51 and a connector 52. The elongate straw tube 51 is connected to the outlet pipe 43, is mounted in the storage recess 11 of the body 10 and has a mounting end and a connecting end. The mounting end of the elongated straw tube 51 is securely mounted around the lower end of the outlet pipe 43. The connector 52 is connected to the elongated straw tube 51, is mounted in the storage recess 11 of the body 10 and has a connecting tube formed through the connector 52 and mounted in the connecting end of the elongated straw tube 51.

In assembly, with reference to FIGS. 2 and 5, the check valves 30 are respectively connected to the valve holes 213 of the lid 20, the straw 2222 is securely connected to the straw hole 2221 and the cover 24 is pivotally connected to the pivot rods 223 of the buffering segment 22. The connector 52 is connected to the connecting end of the elongated straw tube 51, and the mounting end of the elongated straw tube 51 is securely mounted around the lower end of the outlet pipe 43. The mount sealing ring 46 is mounted around the around the sidewall 42 of the dividing mount 40 and the turning arm 44 is turned to enable the sidewall 42 of the dividing mount 40 to connect with the screw tube 221 of the buffering segment 22. Then, the mount sealing ring 46 securely abuts between the abutting segment 45 and the screw tube 221, and the dividing mount 40 and the guiding element 50 are connected to the lid 20. The body sealing ring 25 is mounted in the ring slot 215 and the screwing section 12 of the body 10 is securely connected to the external wall 214 of the threaded segment 21 to connect the lid 20 securely with the body 10.

Figure 6:
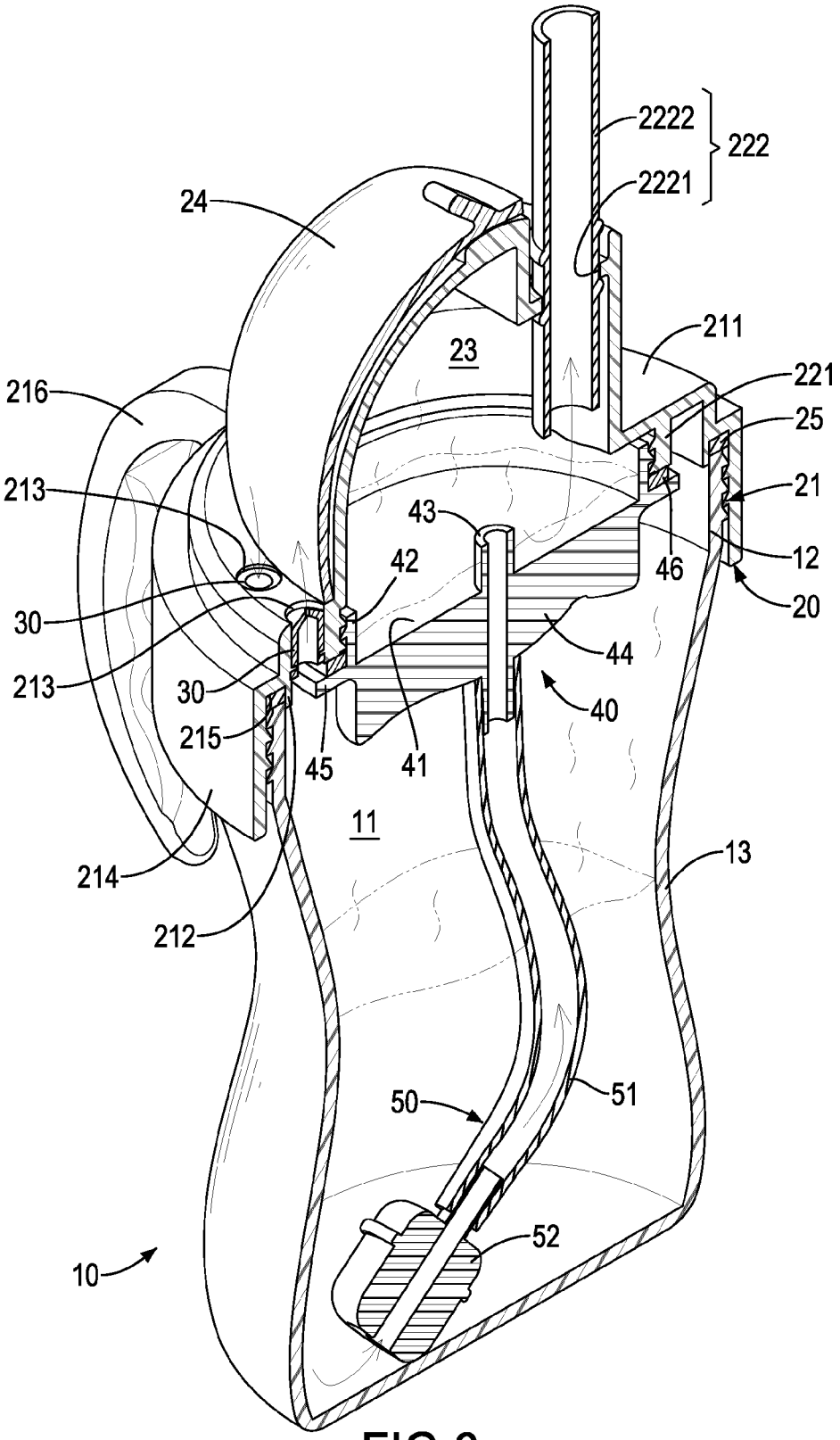
FIG. 6 is an operational and cross sectional perspective view of the anti-spray drinking bottle in FIG. 1.

With reference to FIG. 6, in use, when a hot liquid is stored in the storage recess 11 of the body 10 and the lid 20 is securely connected to the body 10. The dividing mount 40 can divide the storage recess 11 of the body 10 and the buffering recess 23 of the lid 20, and the dividing mount 40 also can prevent the hot liquid or a hot air of the hot liquid in the storage recess 11 from communicating with the buffering recess 23. In addition, the body sealing ring 25 that is mounted between the body 10 and the lid 20 can prevent the hot liquid or the hot air leaking from the body 10. The check valves 30 with different flowing directions, and one of the check valves 30 can enable the hot air of the hot liquid to flow out of the body 10 and the other one can enable the external atmospheric to flow in the body 10, and the imported external atmospheric can enable the holt liquid in the storage recess 11 to flow in the buffering space 23.

When a user wants to suck the hot liquid in the body 10, the hot air in the body 10 can be flowed out of the body 10 via one of the check valves 30 and the user can suck the air that is stored in the buffering space 23 of the lid via the straw 2222. At this time, the external atmospheric can be flowed in the storage recess 11 via the other check valve 30 to enable the hot liquid to flow in the buffering space 23 via the connector 52 and the elongated straw tube 51 to reduce the pressure of the hot liquid, and this can avoid the body 10 to have an excessive pressure due the hot liquid and this also can prevent the hot liquid from flowing of the lid 20 and the body directly.

Because the upper end of the outlet pipe 43 is formed on and protrudes from the top side of the dividing board 41 and the height of the sidewall 42 is longer than the distance between the top side of the dividing board 41 and the upper end of the outlet pipe 43. Therefore, the hot liquid that is imported into the lid 20 can be stored in the buffering space 23 without refluxing backwardly the storage recess 11, and this can enable the user to suck the hot liquid via the inner end of the straw 2222 smoothly.

Figure 7:
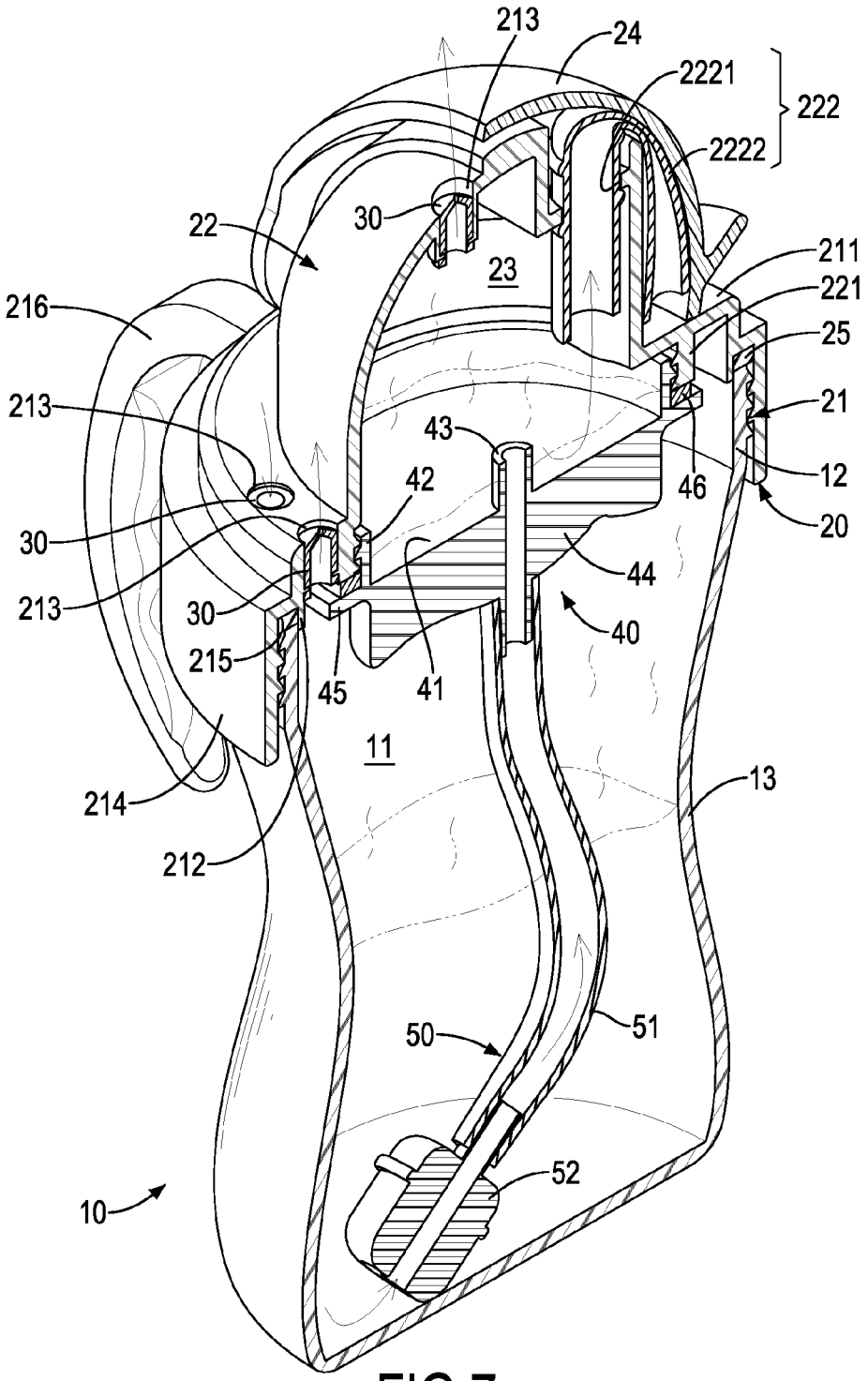
FIG. 7 is an operational and cross sectional perspective view of a second embodiment of an anti-spray drinking bottle in accordance with the present invention.

With reference to FIG. 7, a second embodiment of an anti-spray drinking bottle in accordance with the present invention is substantially the same as the first embodiment except the following features. The lid 20 has three valve holes 213, two of the valve holes 213 are formed through the annular panel 211 of the threaded segment 21 and the other one is formed through the top side of the buffering segment 22 behind the straw hole 2221 of the drawing element 222. In addition, the drinking bottle has three check valves 30, two of the check valves 30 are respectively connected to the valve holes 213 that are formed through the threaded segment 21 and the other one is connected to the valve hole 213 that is formed through the buffering segment 22. Furthermore, the check valve 30 that is connected to the buffering segment 22 can enable air to flow out of the body 10. When the cover 24 is rotated to cover the drawing element 22, the check valve 30 that is connected to the buffering segment 22 can exclude the heat and the pressure of the hot liquid that is stored in the buffering space 23 of the lid 20.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An anti-spray drinking bottle having:

a body having
- a closed bottom;
- an open top;
- an external surface;
- a storage recess formed in the body between the closed bottom and the open top of the body and communicating with the open top of the body; and
- a screwing section formed on the external surface of the body around the open top of the body;

a lid detachably connected to the body and having
- a bottom side;
- a top side;
- a threaded segment formed on the bottom side of the lid, connected to the screwing section of the body and having two valve holes formed through the threaded segment at an interval to communicate with the storage recess;
- a buffering segment connected to the threaded segment and having
  - a bottom side;
  - a top side;
  - an external surface;
  - a screw tube formed on and protruding downwardly from the bottom side of the buffering segment and extending into the threaded segment; and
  - a drawing element connected to the buffering segment; and
- a buffering space formed in the buffering segment between the top side and the bottom side of the buffering segment and communicating with the drawing element;

two check valves connected respectively to the valve holes of the lid and air flowing directions of the check valves are different;

wherein the air flowing direction of one of the check valves is flowed in the body via the corresponding check valve, and the air flowing direction of the other check valve is flowed out of the body via the corresponding check valve;

a dividing mount connected to the lid, mounted in the body and having
- a dividing board mounted between the body and the screw tube of the lid and having
  - a top side;
  - a bottom side; and
  - an outer periphery;
- a sidewall formed on and protruding upwardly from the top side of the dividing board around the outer periphery of the dividing board and securely connected to the screw tube of the lid;
- an outlet pipe connected to the dividing board and having
  - an upper end extending out of the top side of the dividing board and communicating with the buffering space of the lid; and
  - a lower end extending out of the bottom side of the dividing board and extending into the storage recess of the body; and
- an abutting segment being annular, formed around the outer periphery of the dividing board and formed with the sidewall of the dividing mount; and a guiding element connected to the dividing mount, mounted in the body and having an elongated straw tube connected to the lower end of the outlet pipe.

2. The anti-spray drinking bottle as claimed in claim 1, wherein the dividing mount has a mount sealing ring mounted around the sidewall of the dividing mount and securely abutting between the abutting segment and the screw tube of the lid.

3. The anti-spray drinking bottle as claimed in claim 2, wherein
- the threaded segment of the lid has a ring slot formed in the threaded segment; and
- the lid has a body sealing ring mounted in the ring slot of the threaded segment.

4. The anti-spray drinking bottle as claimed in claim 3, wherein the guiding element has a connector connected to the elongated straw tube opposite to the outlet pipe.

5. The anti-spray drinking bottle as claimed in claim 2, wherein a distance between the top side of the dividing board and the upper end of the outlet pipe is shorter than a height of the sidewall of the dividing mount.

6. The anti-spray drinking bottle as claimed in claim 3, wherein a distance between the top side of the dividing board and the upper end of the outlet pipe is shorter than a height of the sidewall of the dividing mount.

7. The anti-spray drinking bottle as claimed in claim 4, wherein a distance between the top side of the dividing board and the upper end of the outlet pipe is shorter than a height of the sidewall of the dividing mount.

8. The anti-spray drinking bottle as claimed in claim 1, wherein a distance between the top side of the dividing board and the upper end of the outlet pipe is shorter than a height of the sidewall of the dividing mount.

* * * * *